US008956015B2

(12) United States Patent
Homma

(10) Patent No.: US 8,956,015 B2
(45) Date of Patent: Feb. 17, 2015

(54) LIGHT-EMITTING APPARATUS AND LIGHTING SYSTEM

(75) Inventor: Dai Homma, Tokyo (JP)

(73) Assignee: Toki Corporation, Tokyo (JP)

( * ) Notice: Subject to any disclaimer, the term of this patent is extended or adjusted under 35 U.S.C. 154(b) by 36 days.

(21) Appl. No.: 13/421,270

(22) Filed: Mar. 15, 2012

(65) Prior Publication Data

US 2013/0033874 A1 Feb. 7, 2013

(30) Foreign Application Priority Data

Aug. 2, 2011 (JP) ..... 2011-169328

(51) Int. Cl.

| | |
|---|---|
| ***F21V 7/00*** | (2006.01) |
| *F21V 8/00* | (2006.01) |
| *F21Y 101/02* | (2006.01) |
| *F21K 99/00* | (2010.01) |

(52) U.S. Cl.

CPC ..... *F21V 7/0091* (2013.01); *F21V 7/0025* (2013.01); *F21V 2008/008* (2013.01); *F21Y 2101/02* (2013.01); *F21K 9/52* (2013.01)

USPC ..... 362/310; 362/84; 362/558; 362/606

(58) Field of Classification Search

CPC ..... F21S 48/1154; F21S 48/1163; F21S 48/1233; F21S 48/1329; F21S 48/1388; F21S 48/1291; G02B 19/0061; G02B 19/0028; G02B 17/0605; F21V 7/0091; F21V 5/04; F21K 9/00

USPC ..... 362/84, 296.06, 558, 800, 362, 311.06, 362/311.01, 249.02, 606, 611, 310, 609, 362/282, 296.01, 296.05, 277

See application file for complete search history.

(56) References Cited

U.S. PATENT DOCUMENTS

| | | | | |
|---|---|---|---|---|
| 7,850,346 | B1 * | 12/2010 | Lauer | 362/362 |
| 2001/0033488 | A1 * | 10/2001 | Chliwnyj et al. | 362/231 |
| 2004/0120153 | A1 * | 6/2004 | Pate | 362/296 |
| 2005/0068786 | A1 * | 3/2005 | Ishida | 362/509 |

(Continued)

FOREIGN PATENT DOCUMENTS

| | | |
|---|---|---|
| CN | 101598304 A | 12/2009 |
| JP | 2004-296249 | 10/2004 |

(Continued)

OTHER PUBLICATIONS

English Abstract of JP Application No. 2006-038519, Publication No. 2007-220432, Mar. 9, 2012, Patent Abstracts of Japan, Japanese Patent Office Website.

(Continued)

*Primary Examiner* — Anh Mai
*Assistant Examiner* — Kevin Quarterman
(74) *Attorney, Agent, or Firm* — Z IP Law PLLC; Claire Zopf

(57) ABSTRACT

A light-emitting apparatus includes a light-emitting diode that functions as a light source, and a teardrop-shaped translucent member formed of a translucent material. The teardrop-shaped translucent member includes a bottom portion via which the light emitted from the light-emitting diode is input, a lateral portion configured to provide total internal reflection of the light input via the bottom portion, and a top portion configured to focus the light subjected to total internal reflection by the lateral portion so as to form an image.

8 Claims, 11 Drawing Sheets

(56) References Cited

U.S. PATENT DOCUMENTS

| | | | | |
|---|---|---|---|---|
| 2006/0109669 | A1* | 5/2006 | Tanaka et al. | 362/459 |
| 2008/0285297 | A1* | 11/2008 | Ishida | 362/539 |

FOREIGN PATENT DOCUMENTS

| | | |
|---|---|---|
| JP | 2005-095335 | 4/2005 |
| JP | 2006147448 | 8/2006 |
| JP | 2007-194132 | 2/2007 |
| JP | 2007-220432 | 8/2007 |
| JP | 2009-009870 | 1/2009 |

OTHER PUBLICATIONS

Japanese Patent Office, Notification of Reason(s) for Refusal for Japanese Appln. No. 2011-169328, Aug. 20, 2013.

Japanese Patent Office, Patent Abstracts of Japan for Japanese Patent Publication No. 2009-009870.

Japanese Patent Office, Patent Abstracts of Japan for Japanese Patent Publication No. 2007-194132.

Japanese Patent Office, Patent Abstracts of Japan for Japanese Patent Publication No. 2005-095335.

Japanese Patent Office, Patent Abstracts of Japan for Japanese Patent Publication No. 2004-296249.

State Intellectual Property Office, First Office Action for Chinese Patent Appln. No. 201210272715.3, dated Jan. 21, 2014.

Japanese Patent Office, Notification of Reason(s) for Refusal for Japanese Patent Appln. No. 2011-169328, dated Jan. 7, 2014.

Japanese Patent Office, Patent Abstract of Japan for Japanese Patent Publication No. 2006-147448.

State Intellectual Property Office of China, Second Office Action on Chinese Appln. No. 201210272715.3, dated Sep. 30, 2014, and English Translation.

* cited by examiner

LIGHT-EMITTING APPARATUS AND LIGHTING SYSTEM

BACKGROUND OF THE INVENTION

1. Field of the Invention

The present invention relates to a light-emitting apparatus employed for illumination or for decorative illumination, and particularly to a light-emitting apparatus and a lighting system employing a light-emitting diode (LED).

2. Description of the Related Art

In recent years, as the performance of light-emitting diodes has been remarkably improved, such light-emitting diodes are coming to be employed for store illumination, decorative illumination, or otherwise for household illumination, as well as being employed in conventional applications such as small-size indicators, backlights, etc.

Such a light-emitting diode is strongly directional, leading to difficulty in employing such a light-emitting diode as it is as an alternative to an incandescent light bulb. In order to solve such a problem, for example, Patent document 1 discloses a light-emitting apparatus in which a translucent surrounding member having a surface subjected to frosting processing is arranged such that it surrounds a light-emitting diode, thereby providing diffused illumination with an approximately uniform magnitude over nearly all directions on the exterior of the surrounding member.

RELATED ART DOCUMENTS

Patent Documents

[Patent document 1]

Japanese Patent Application Laid Open No. 2007-220432

However, even in a case in which such a surrounding member is arranged such that it surrounds a light-emitting diode as disclosed in Patent document 1, such a light-emitting apparatus provides almost no illumination toward its reverse direction. That is to say, it is difficult for such a light-emitting apparatus employing a light-emitting diode to provide omni-directional light emission in the same way as with traditional incandescent light bulbs.

Also, a method in which light is emitted in the reverse direction of a light-emitting apparatus using a light reflector is conceivable. However, with such a method, such an arrangement provides illumination similar to light shining from the entire area of the light reflector. That is to say, it is difficult for such an arrangement to provide an illumination effect similar to a shining filament of an incandescent light bulb.

SUMMARY OF THE INVENTION

The present invention has been made in view of such a situation. Accordingly, it is a general purpose of the present invention to provide a light-emitting apparatus and a lighting system which is capable of providing an illumination effect similar to that of an incandescent light bulb.

In order to solve the aforementioned problem, a light-emitting apparatus according to an embodiment of the present invention comprises: a light source; and a translucent member formed of a light-translucent material, comprising a bottom portion via which light emitted from the light source is input, a lateral portion configured to provide total internal reflection of light input via the bottom portion, and an image formation portion at which the light subjected to total internal reflection by the lateral portion is focused so as to form an image.

Such an embodiment is capable of generating a virtual light-emitting portion at a position away from an actual light source. Furthermore, such an embodiment provides a state in which the actual light source cannot be seen. Thus, such an arrangement provides an illumination effect similar to a shining filament of an incandescent light bulb.

Also, the translucent member may be configured to form an image obtained by alteration of the shape of the light source.

Also, the translucent member may be configured to form an image obtained by expanding or otherwise by reducing the shape of the light source.

Also, the translucent member may further include multiple reflectors embedded therewithin.

Also, the translucent member may further include a diffusion portion configured to diffuse, to the exterior of the translucent member, the light from an image formed at the image formation portion.

Also, the light source may be configured as a light-emitting diode.

Also, the translucent member may be configured in a teardrop shape. Also, the image formation portion may be arranged at the top portion of the teardrop-shaped translucent member, or otherwise at a position in the vicinity of the top portion.

Another embodiment of the present invention relates to a lighting system. The lighting system comprises: the aforementioned light-emitting apparatus; and an optical member configured to control the light emitted from the light-emitting apparatus so as to provide a predetermined light distribution.

Also, the optical member may include a reflector portion configured to reflect, in a predetermined direction, the light emitted from the light-emitting apparatus.

It should be noted that any combination of the aforementioned components or otherwise any manifestation of the present invention may be mutually substituted between an apparatus, method, system, and so forth, which are effective as an embodiment of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described by reference to the preferred embodiments. This does not intend to limit the scope of the present invention, but to exemplify the invention.

Figure 1:
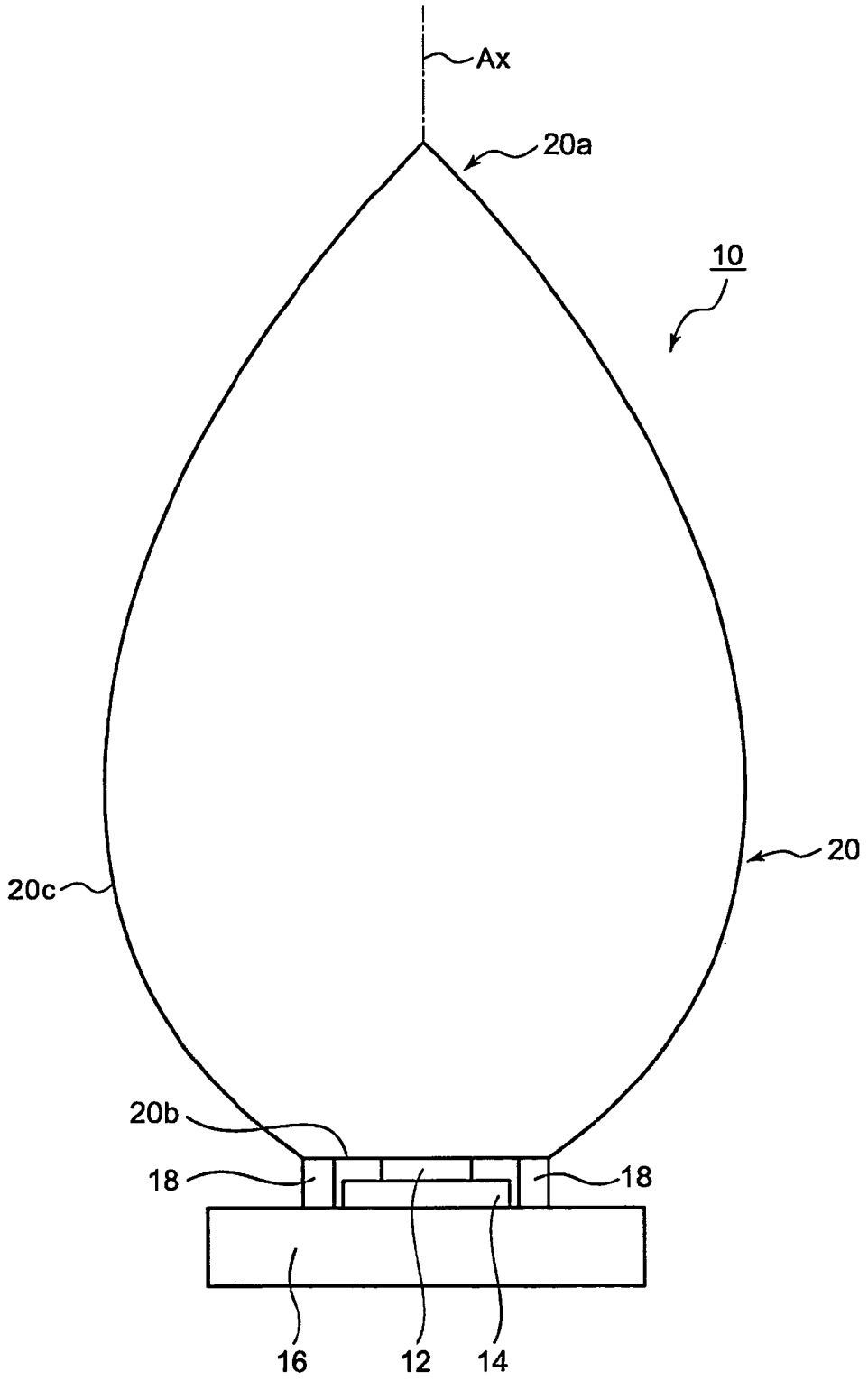
FIG. 1 is a longitudinal cross-sectional diagram for describing a light-emitting apparatus according to an embodiment of the present invention.

FIG. 1 is a longitudinal cross-sectional diagram for describing a light-emitting apparatus according to an embodiment of the present invention. As shown in FIG. 1, a light-emitting apparatus 10 includes a light-emitting diode 12 configured as a light source, a circuit board 14 configured to supply current to the light-emitting diode 12, a base member 16 configured to support the circuit board 14, a teardrop-shaped translucent member 20 configured to receive light from the light-emitting diode 12, and a support member 18 configured to support the teardrop-shaped translucent member 20 on the base member 16. The base member 16 also functions as a heat sink configured to release heat generated by the light-emitting diode 12.

In the embodiment shown in FIG. 1, the light-emitting diode 12 is configured as a surface-mounted light-emitting diode. Such a surface-mounted light-emitting diode has a configuration which allows a heat sink to be arranged easily as compared with a bullet-shaped light-emitting diode, thereby allowing a large amount of current to flow through the light-emitting diode, thereby providing high-luminance light emission.

The teardrop-shaped translucent member 20 is formed of a translucent material such as acrylic resin or the like. Here, "teardrop-shaped" represents an approximately spheroid structure, along the longitudinal axis of which one end is tapered. The teardrop-shaped translucent member 20 has a tapered top portion 20*a*, a bottom portion 20*b* formed at the other end of the longitudinal axis of the approximately spheroid structure, and a lateral portion 20*c* formed between the top portion 20*a* and the bottom portion 20*b*. The bottom portion 20*b* is configured in the form of a circular plane orthogonal to the central axis Ax of the teardrop-shaped translucent member 20. The lateral portion 20*c* of the teardrop-shaped translucent member 20 is configured to provide total internal reflection of the light input to the interior of the teardrop-shaped translucent member 20 via the bottom portion 20*b* so as to form an image in the vicinity of the top portion 20*a*.

The teardrop-shaped translucent member 20 is arranged such that the bottom portion 20*b* is positioned on the light-emitting face of the light-emitting diode 12. The teardrop-shaped translucent member 20 is preferably arranged such that its central axis Ax orthogonally intersects the center of the light-emitting face of the light-emitting diode 12. With such an embodiment shown in FIG. 1, the light-emitting face of the light-emitting diode 12 is in contact with the bottom portion 20*b* of the teardrop-shaped translucent member 20. Also, an arrangement may be made configured such that there is a gap between the light-emitting face of the light-emitting diode 12 and the bottom portion 20*b* of the teardrop-shaped translucent member 20.

Figure 2:
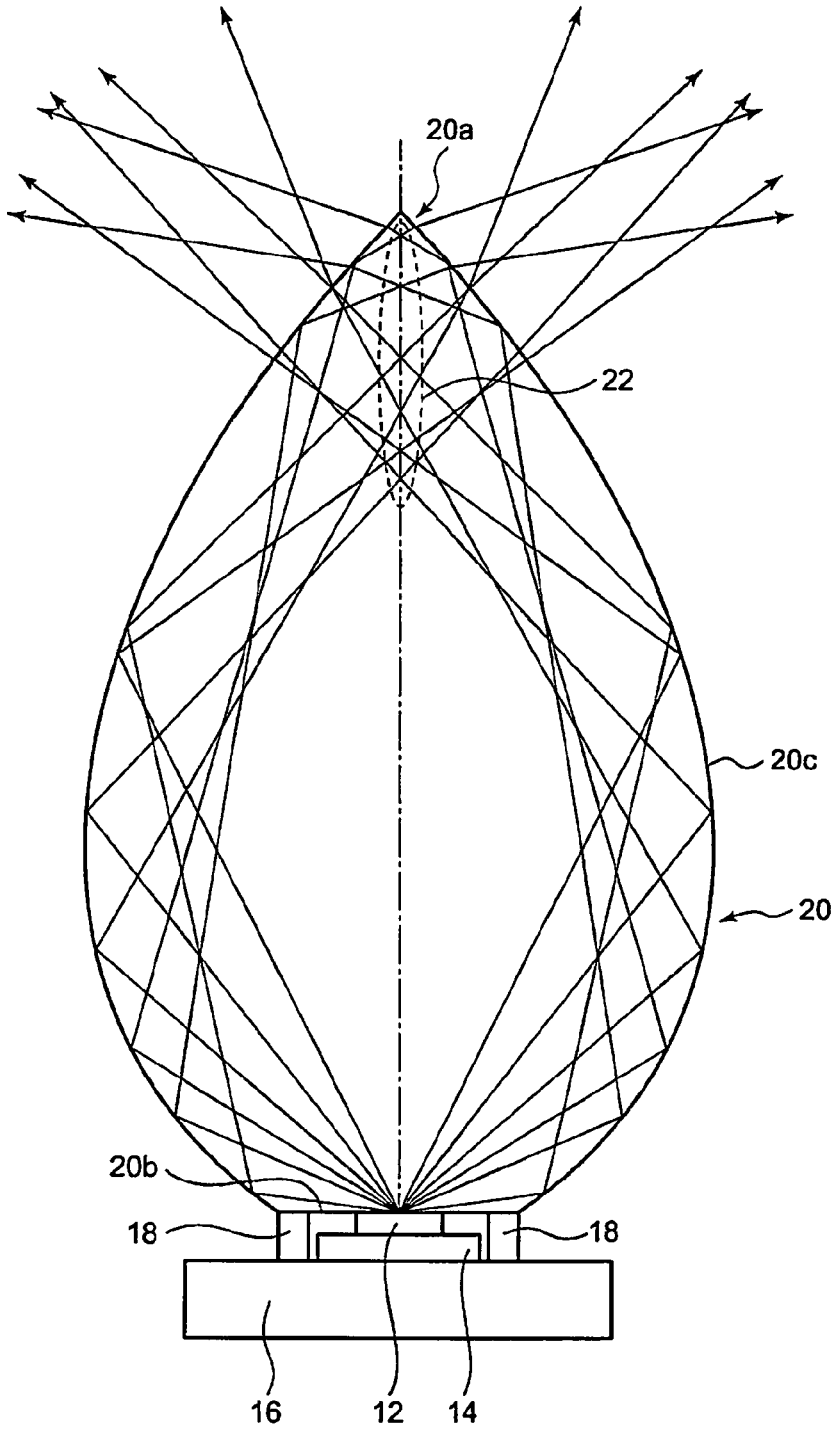
FIG. 2 is a longitudinal cross-sectional diagram for describing light emission provided by the light-emitting apparatus according to the present embodiment.

FIG. 2 is a longitudinal cross-sectional diagram for describing light emission provided by the light-emitting apparatus according to the present embodiment. The light-emitting diode 12 is configured as a surface-emitting light source. However, description will be made with the light-emitting diode 12 regarded as a point light source. The light-emitting diode 12 is configured to emit light at various emission angles.

The light emitted from the light-emitting diode 12 is input to the interior of the teardrop-shaped translucent member 20 via the bottom portion 20*b*. The light input to the interior of the teardrop-shaped translucent member 20 is subjected to total internal reflection by the lateral portion 20*c*, following which the reflected light converges so as to form a linear image 22 in the vicinity of the top portion 20*a*. The light that forms the linear image 22 is output to the exterior of the teardrop-shaped translucent member 20 via the lateral portion 20*c* in the vicinity of the top portion 20*a*. Thus, such an arrangement appears to provide light emission via the luminescence of a linear portion in the vicinity of the top portion 20*a*. Accordingly, the linear image 22 can be said to be a virtual light-emitting portion. The light input to the lateral portion 20*c* via the bottom portion 20*b* is subjected to total internal reflection by the lateral portion 20*c* at least once. Thus, when the lateral portion 20*c* is viewed from the outside of the teardrop-shaped translucent member 20, the light-emitting diode 12 cannot be seen.

Figure 3:
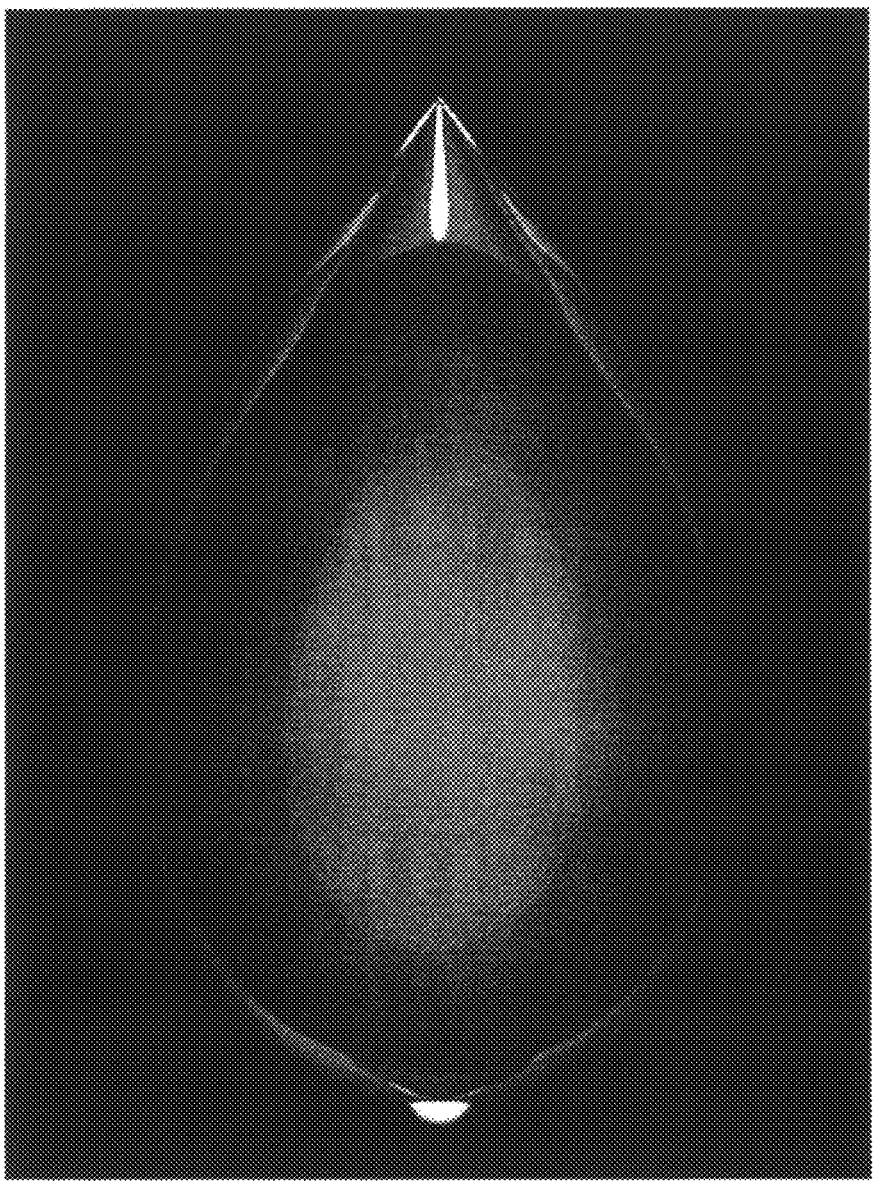
FIG. 3 is a diagram which shows ray-trace simulation results.

FIG. 3 shows ray-trace simulation results. As shown in FIG. 3, it can be clearly understood that the light input via the bottom portion of the teardrop-shaped translucent member forms a linear image in the vicinity of the top portion of the teardrop-shaped translucent member. It should be noted that the light from the light source shown in FIG. 3 is directly seen without the mediation of the teardrop-shaped translucent member, and thus the form of the light source cannot be seen via the teardrop-shaped translucent member.

Figure 4:
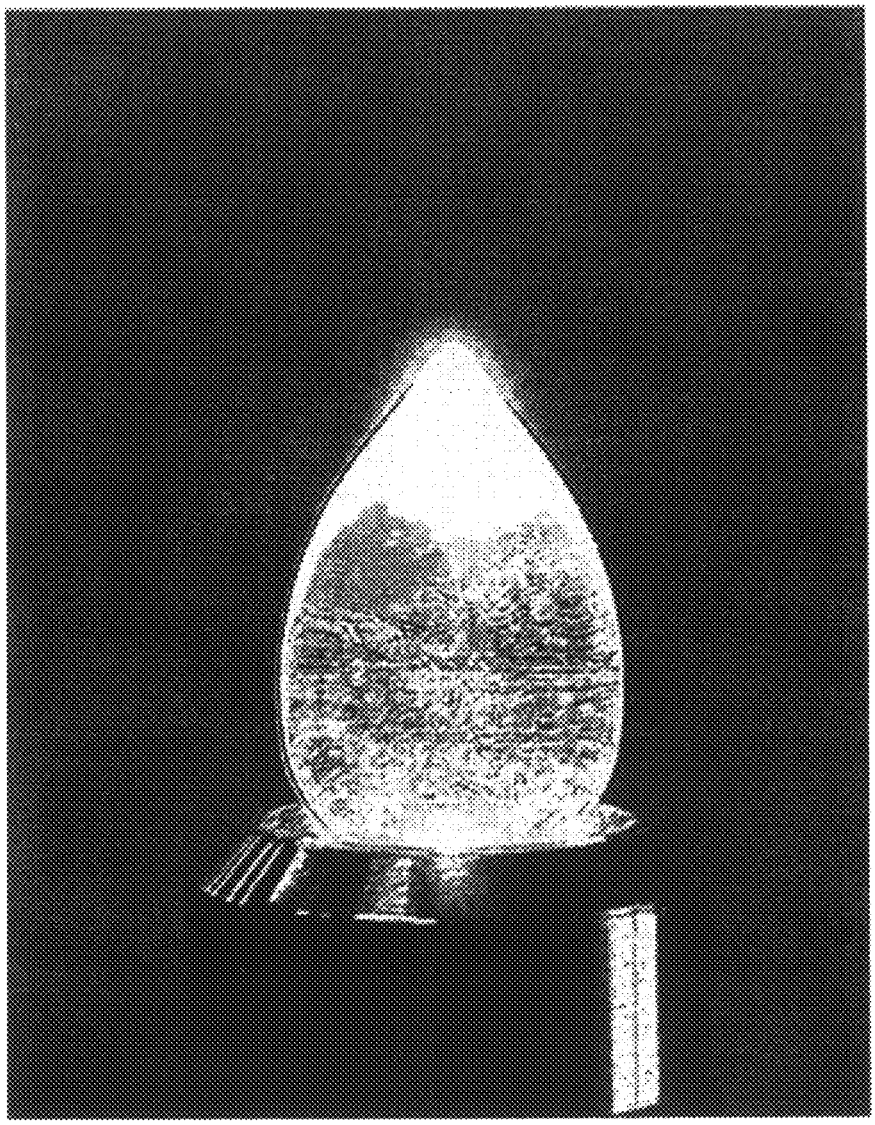
FIG. 4 is a diagram which shows an actually-manufactured prototype light-emitting apparatus.

FIG. 4 shows an actually-manufactured prototype light-emitting apparatus. As shown in FIG. 4, it can be clearly understood that the top portion of the teardrop-shaped translucent member shines in a manner similar to the shining of a filament of an incandescent light bulb. As described above, with the light-emitting apparatus according to the present embodiment, by employing such a teardrop-shaped translucent member, such an arrangement is capable of providing a virtual light-emitting portion at a position that differs from that of the light source.

For example, a conventional arrangement in which the light output from a surface-emitting LED is directly reflected by a reflector, such as an ordinary lighting system employing an LED, has a problem in that it is difficult to design such a reflector for a large-area light-emitting surface. Furthermore, currently, there is a demand for high-luminance lighting systems employing an LED. In order to meet such a demand, such an LED lighting system has a structure in which multiple LED chips are arranged in a single package (which will also be referred to as a "multi-chip LED"). Such a multi-chip LED also provides an effect of leveling off irregularities in the color of light emitted by the respective LED chips, thereby providing an advantage of making such irregularities in the color of light emitted become inconspicuous. However, such an arrangement in which a light source is configured as a multi-chip LED involves a large-area light-emitting surface, leading to a difficulty in designing a reflector. In contrast, with the light-emitting apparatus according to the present embodiment, such an arrangement is capable of focusing the light and forming an image in the top portion, or otherwise in a portion in the vicinity of the top portion, of the teardrop-shaped translucent member so as to provide a virtual light-emitting portion having a desired size, even if the light source is large in size to some extent. Thus, such an arrangement allows a reflector to be designed easily for such a virtual light emitting portion that functions as a light source. Such an arrangement facilitates the design of lighting systems such as downlights, spotlights, and so forth, employing a large-size surface-mounted LED or otherwise a multi-chip LED.

Also, in the field of decorative illumination, there is a great demand for clear-type incandescent light bulbs, and there is a great demand for light-emission that possesses the qualities of light emitted from a filament of an incandescent light bulb. In order to meet such demands, there have been various experimental trials thus far, examples of which include an arrangement in which an LED element is employed like an actual filament of an incandescent light bulb, and an arrangement in which a base configured to mount a surface-mounted LED is arranged to allow the LED to emit light through the central position of the bulb. The former arrangement involves difficulty in releasing heat, leading to a problem of a short product life and a difficulty in designing a high-luminance light bulb. On the other hand, the latter arrangement requires a base arranged in the vicinity of the center of the bulb. Accordingly, in a case in which the latter arrangement is applied to a clear-type light bulb, such an arrangement involves a problem in that such a base is conspicuous, leading to a problem from the viewpoint of its appearance. In contrast, the light-emitting apparatus according to the present embodiment is capable of providing a virtual linear light-emitting portion like a filament at a position away from a light source. Thus, such an arrangement does not require such a special base having an extended structure, thereby providing an advantage in that there is less of a problem with its appearance. Furthermore, such an arrangement provides a virtual light-emitting portion at a position away from an actual light source, which allows the designer to make sufficient countermeasures for releasing heat from such an actual light source.

Figures 5A, 5B, 5C, 5D:
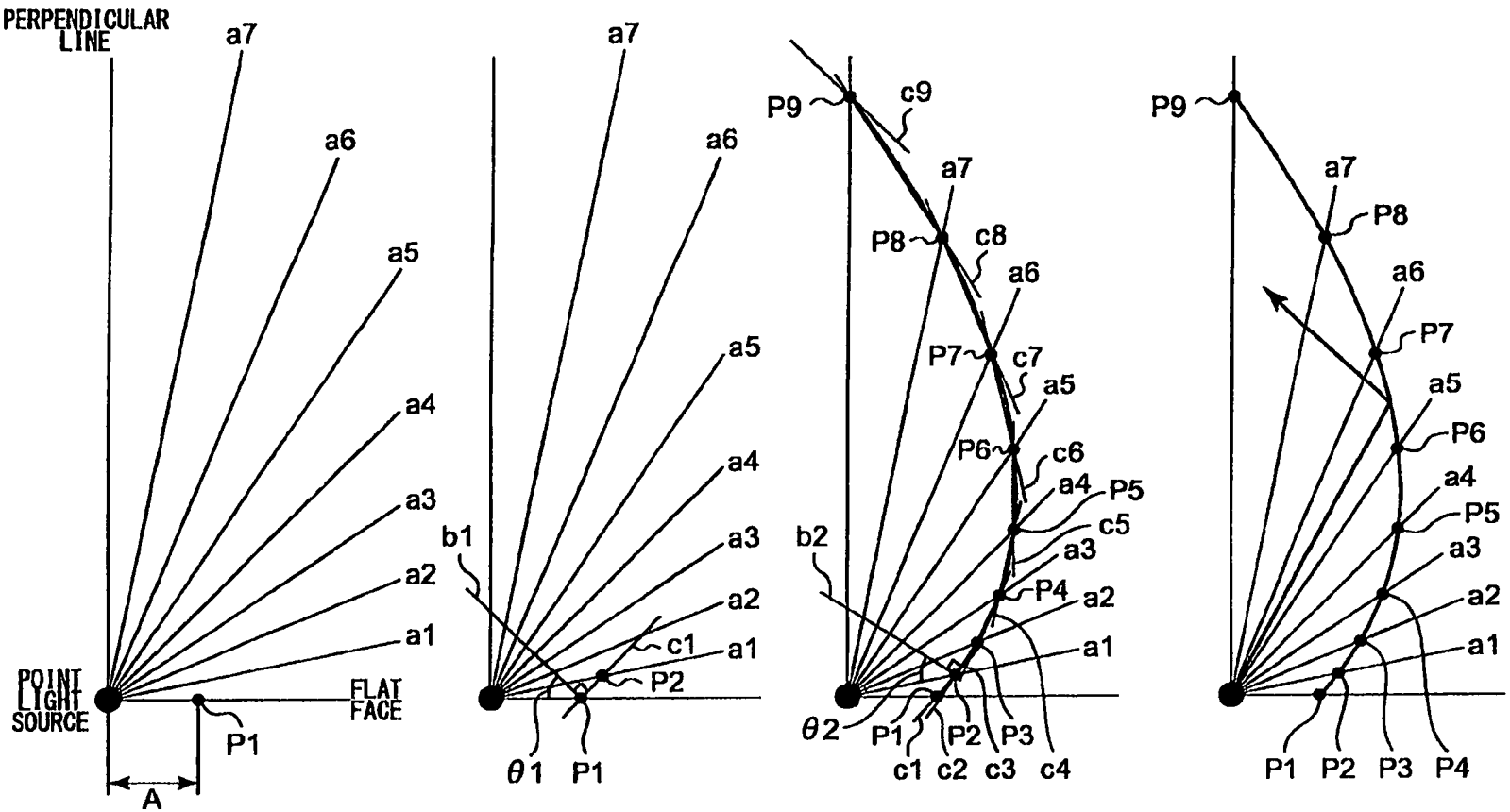
FIGS. 5A through 5D are diagrams for describing a method for designing a teardrop-shaped translucent member.

FIGS. 5A through 5D are diagrams for describing a method for designing such a teardrop-shaped translucent member. First, as shown in FIG. 5A, let us assume that a point light source is positioned on a flat face of a substrate or the like. Next, a perpendicular line that is orthogonal to the flat face is drawn such that it passes through the point light source. Next, (n−1) auxiliary lines are drawn so as to divide the angle between the perpendicular line and the flat face into n angles. Here, let us say that seven auxiliary lines a1 through a7 are drawn such that they divide the angle between the perpendicular line and the flat face into eight angles. The auxiliary line a1 is the closest to the flat face side, and the auxiliary line a7 is the closest to the perpendicular line side. It should be noted that description will be made in the present embodiment regarding an arrangement in which the angle between the perpendicular line and the flat face is equally divided for ease of description. However, the present invention is not restricted to such an arrangement in which this angle is equally divided. Next, the radius A of the face of the bottom portion is determined. The radius A of the bottom face functions as a parameter for determining the size of the teardrop-shaped translucent member. As shown in FIG. 5A, a point on the flat face at a distance of the radius A from the point light source is set to be P1.

Next, as shown in FIG. 5B, an auxiliary line bi is drawn such that it passes through the point P1. Here, the auxiliary line b1 is set such that the angle θ1 between the auxiliary line b1 and the line that connects the point light source and the point P1 is greater than the critical angle θc of the teardrop-shaped translucent member. The critical angle θc is determined based upon the following Expression (1) using the refractive index n1 of the teardrop-shaped translucent member and the refractive index n2 of the medium (e.g., the air) outside of the teardrop-shaped translucent member.

$$\theta c = \arcsin(n2/n1) \quad (1)$$

Next, an auxiliary line c1 that is orthogonal to the auxiliary line b1 is drawn such that it passes through the point P1. The point of intersection between the auxiliary line c1 and the auxiliary line a1 is defined as P2.

Next, as shown in FIG. 5C, an auxiliary line b2 is drawn such that it passes through the point P2. Here, the auxiliary line b2 is set such that the angle θ2 between the auxiliary line b2 and the line that connects the point light source and the point P2 is greater than the critical angle θc. The angle θ2 may be determined to be equal to the angle θ1, or otherwise to be different from the angle θ1. Next, an auxiliary line c2 is drawn such that it passes through the point P2 and is orthogonal to the auxiliary line b2. The point of intersection between the auxiliary line c2 and the auxiliary line a2 is determined as P3. Similar procedures are repeatedly performed as the following steps. Lastly, the point of intersection P9 between the auxiliary line c9 and the corresponding perpendicular line is determined.

By connecting the points 1 through 9 thus determined, the external shape of the lateral portion of the teardrop-shaped translucent member is determined as shown in FIG. 5D. As the number of divisions n by which the angle between the perpendicular line and the flat face is to be divided is increased, the curve that defines the external shape of the teardrop-shaped translucent member becomes smoother. Also, as an approximate method, the respective points may be connected by a smooth curve, as shown in FIG. 5D. It should be noted that description has been made regarding the right-side portion of the teardrop-shaped translucent member in the transverse cross-sectional diagram. It is needless to say the left-side portion thereof may be designed in the same way.

Figure 6:
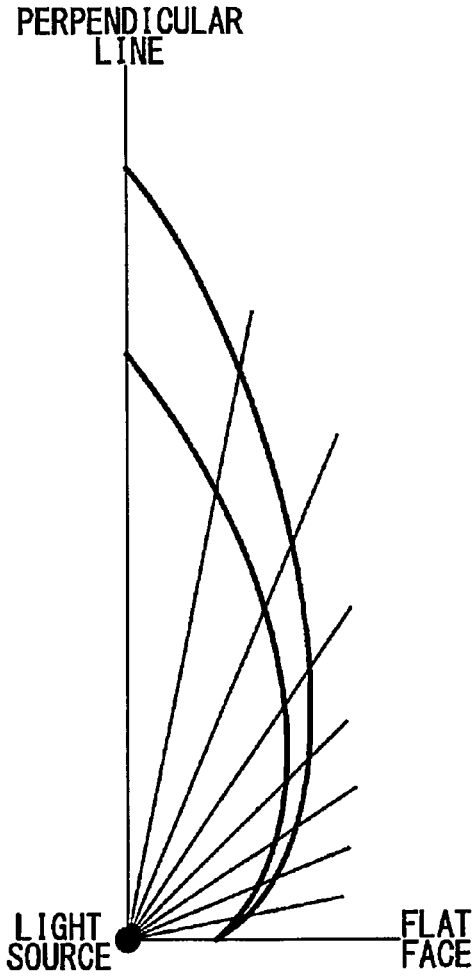
FIG. 6 is a diagram which shows teardrop-shaped translucent members having various external shapes.

The angle θn set for the auxiliary line bn for the point Pn may be determined as desired so long as it is greater than the critical angle θc of the teardrop-shaped translucent member. By changing the value of each angle θn, such an arrangement allows the teardrop-shaped translucent member to have various external shapes as shown in FIG. 6.

Figure 7:
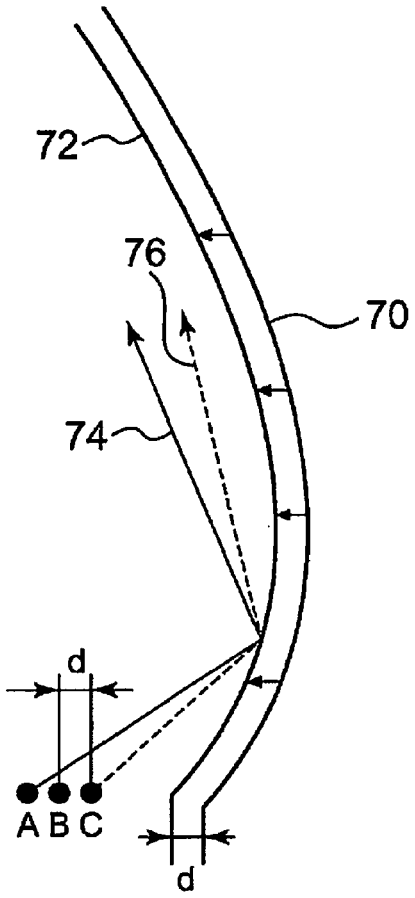
FIG. 7 is a diagram for describing a method for designing a teardrop-shaped translucent member in a case in which the light source is configured as a surface light source.

FIG. 7 is a diagram for describing a method for designing the teardrop-shaped translucent member in a case in which the light source is configured as a surface light source. Such a surface light source can be assumed to be equivalent to multiple point light sources arranged laterally as viewed in the transverse cross-sectional diagram. Here, let us consider an arrangement in which three point light sources A through C are arranged laterally. In this case, first, with regard to the point light source B in the middle position, the outline 70 of the right-side region of the lateral portion of the teardrop-shaped translucent member is drawn using the method described above with reference to FIGS. 5A through 5D. Next, the outline 70 is offset inward (toward the left) by the radius d of the surface light source. The outline 72 thus offset is equal to the outline designed for the point light source A on the left end. By designing the outline 72 so as to provide total internal reflection of the light 74 emitted from the point light source A on the left end, such an arrangement ensures that the light 76 emitted from the point light source B in the middle position, or otherwise from the light source C on the right end, reaches the outline 72 at an incident angle that is greater than the light 74. Thus, such an arrangement ensures total internal reflection of the light from all the point light sources. By further designing the outline for the left-side region of the lateral portion of the teardrop-shaped translucent member in the same way as the right-side region, the teardrop-shaped translucent member can be designed for such a surface light source. It is a feature of such an arrangement employing such a surface light source that its teardrop-shaped translucent member has a width that is smaller than that of an arrangement employing a point light source.

Figure 8:
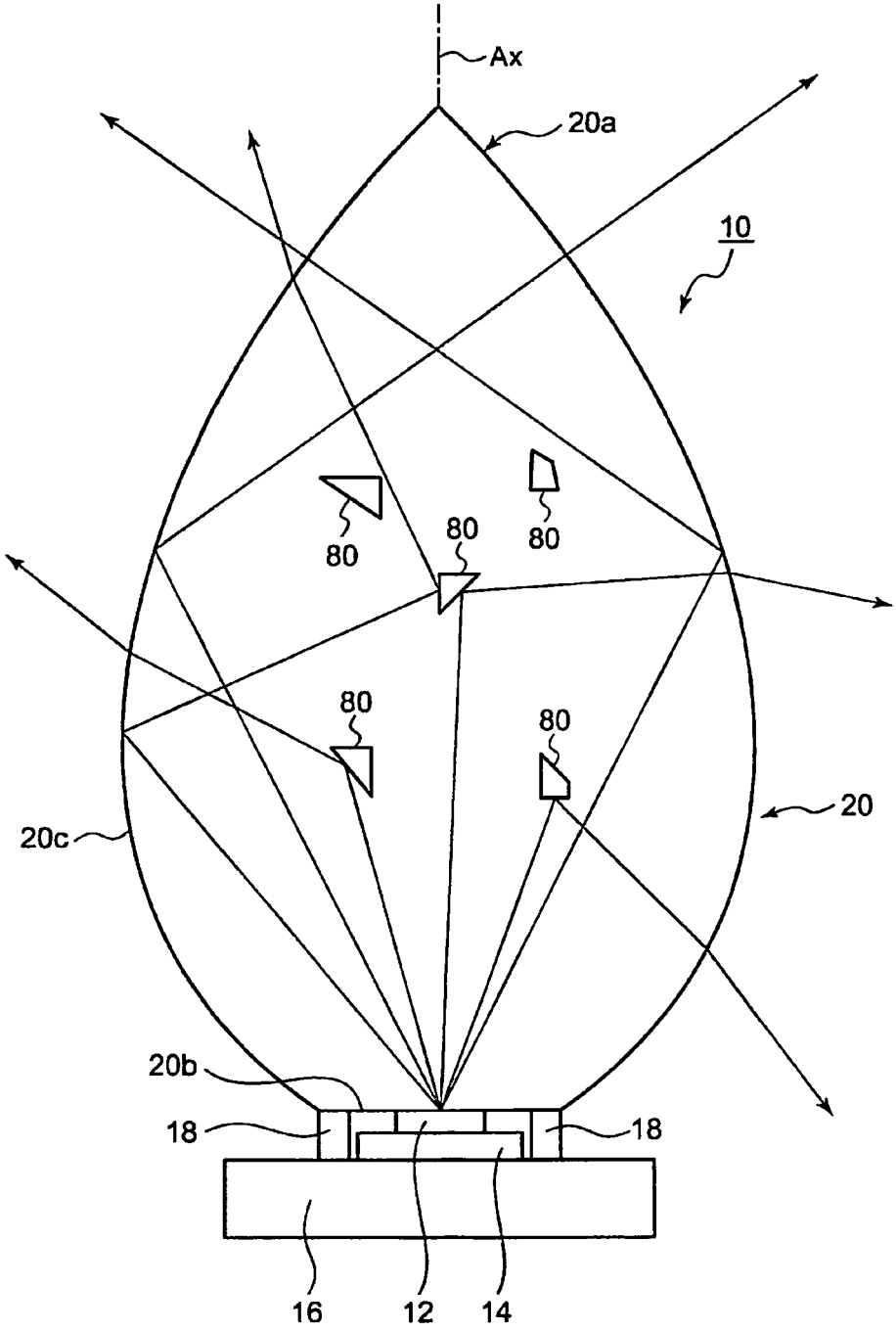
FIG. 8 is a diagram for describing a modification of the light-emitting apparatus.

FIG. 8 is a diagram for describing a modification of a light-emitting apparatus. As shown in FIG. 8, the light-emitting apparatus 10 according to the present modification has a structure in which multiple microscopic reflectors 80 are embedded in the teardrop-shaped translucent member 20. Such reflectors may each be configured as a prism, reflecting mirror, or the like. The shape of each reflector 80 is not restricted in particular. Each reflector 80 may have a polygonal shape such as a triangle, rectangle, or the like.

By configuring the teardrop-shaped translucent member 20 including such reflectors 80 embedded within it, such an arrangement allows the light input from the light-emitting diode 12 to the teardrop-shaped translucent member 20 to be diffused in various directions, in addition to allowing the light to be focused so as to form an image in the vicinity of the top portion 20*a*.

Figure 9:
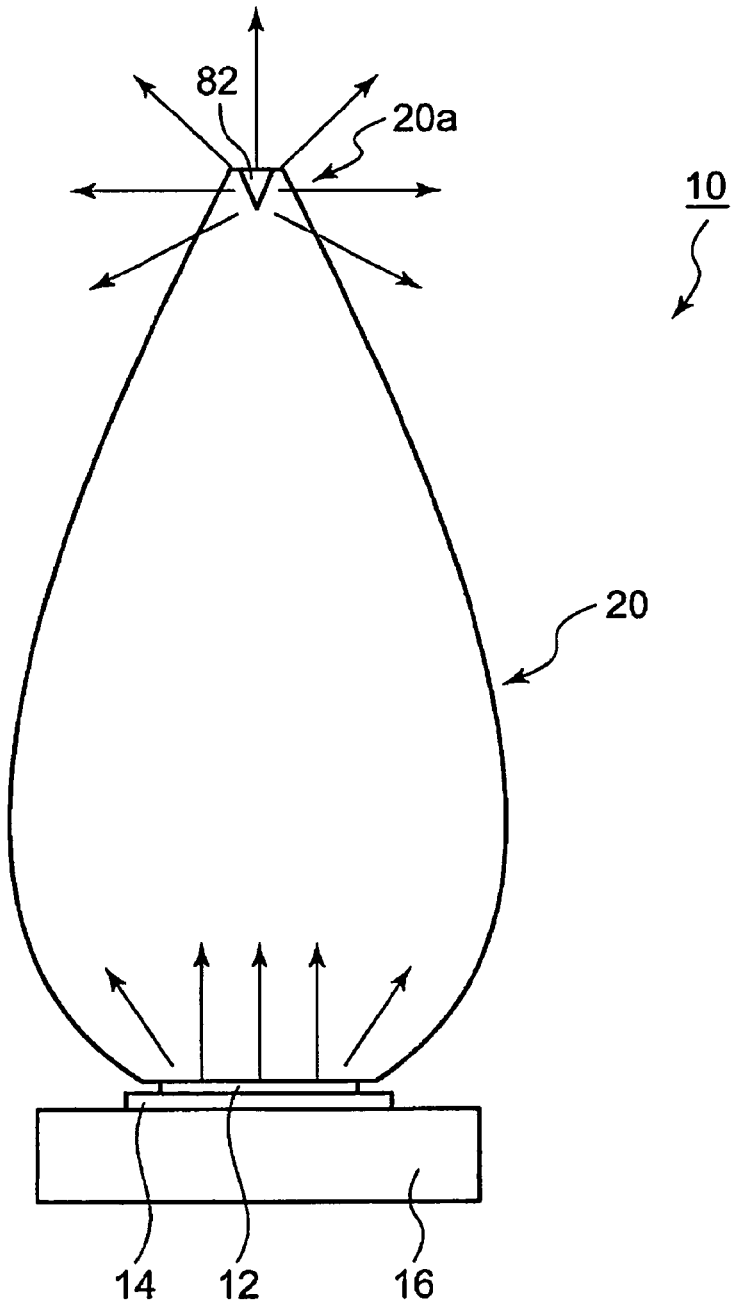
FIG. 9 is a diagram for describing another modification of the light-emitting apparatus.

FIG. 9 is a diagram for describing another modification of the light-emitting apparatus. As shown in FIG. 9, the light-emitting apparatus 10 according to the present modification has a structure in which a recessed portion 82 having a V-shaped cross-sectional shape is formed in the top portion 20*a*. The recessed portion 82 functions as a diffusing portion configured to allow part of the light from an image formed at the top portion 20*a* to be diffused to the exterior of the translucent member. By providing such a recessed portion 82 in the top portion 20*a* of the teardrop-shaped translucent member 20 as described above, such an arrangement allows the light input from the light-emitting diode 12 to the interior of the teardrop-shaped translucent member 20 to be diffused in various directions, in addition to the light being focused so as to form an image in the vicinity of the top portion 20*a*.

Figure 10:
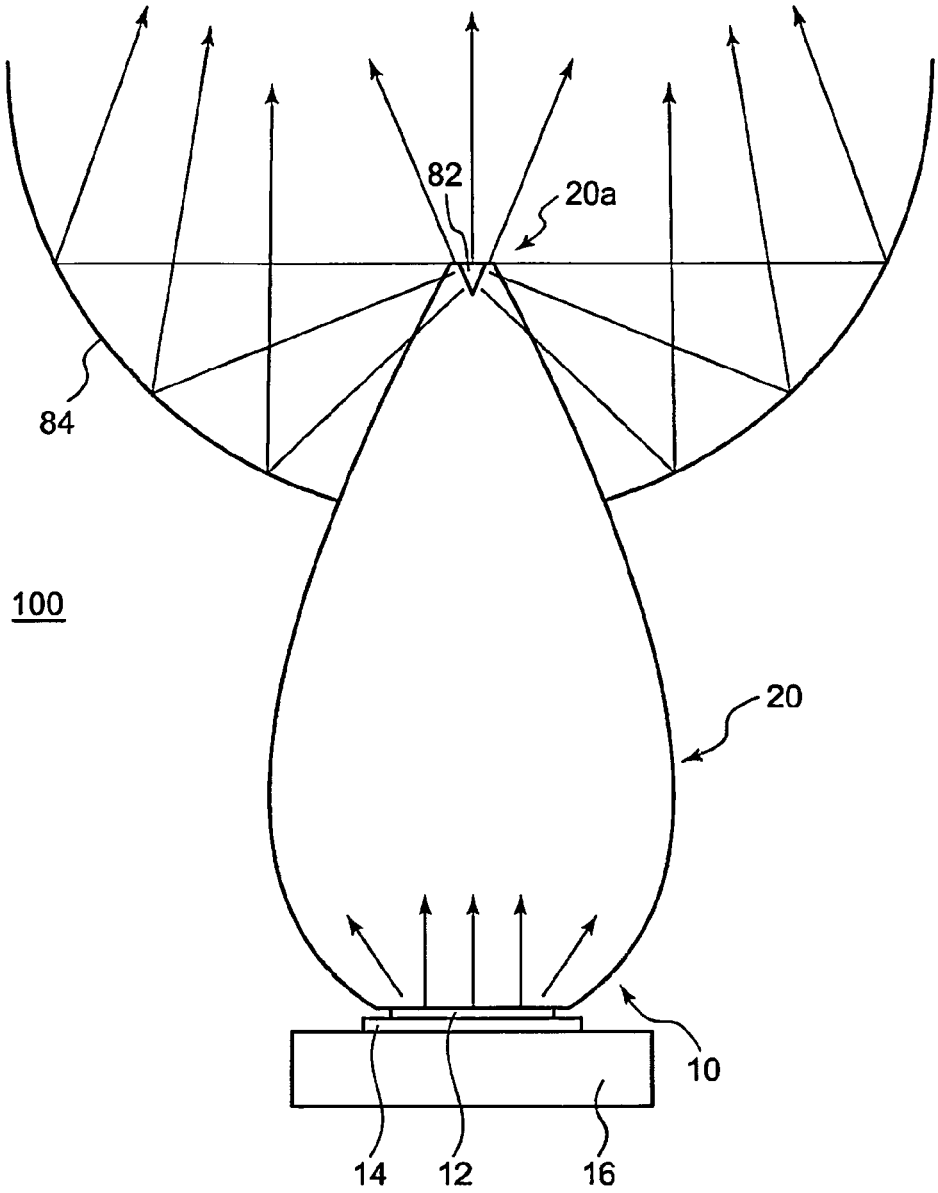
FIG. 10 is a diagram which shows an illumination a lighting system according to an embodiment of the present invention.

FIG. 10 is a lighting system according to an embodiment of the present invention. As shown in FIG. 10, a lighting system 100 includes the light-emitting apparatus 10 shown in FIG. 9, a parabolic reflecting mirror 84 configured to reflect, upward from the light-emitting apparatus 10, the light diffused via the recessed portion 82 of the light-emitting apparatus 10, and a translucent cover member (not shown) arranged so as to surround the light-emitting apparatus 10 and the reflecting mirror 84. The cover member may be configured to have the same shape as that of an ordinary incandescent light bulb. As described above, by providing the light-emitting apparatus 10 with such a reflecting mirror 84, such an arrangement provides a lighting system configured to generate desired light distribution such as parallel light, spot light, and so forth. Examples of such a lighting system include a downlight, a spotlight, and so forth. By employing such a light-emitting apparatus 10 which is capable of generating a virtual light-emitting portion at a position that differs from that of its actual light source as described above, such an arrangement allows the reflecting mirror 84 to be designed easily even if the light source is large in size to some extent.

Figure 11:
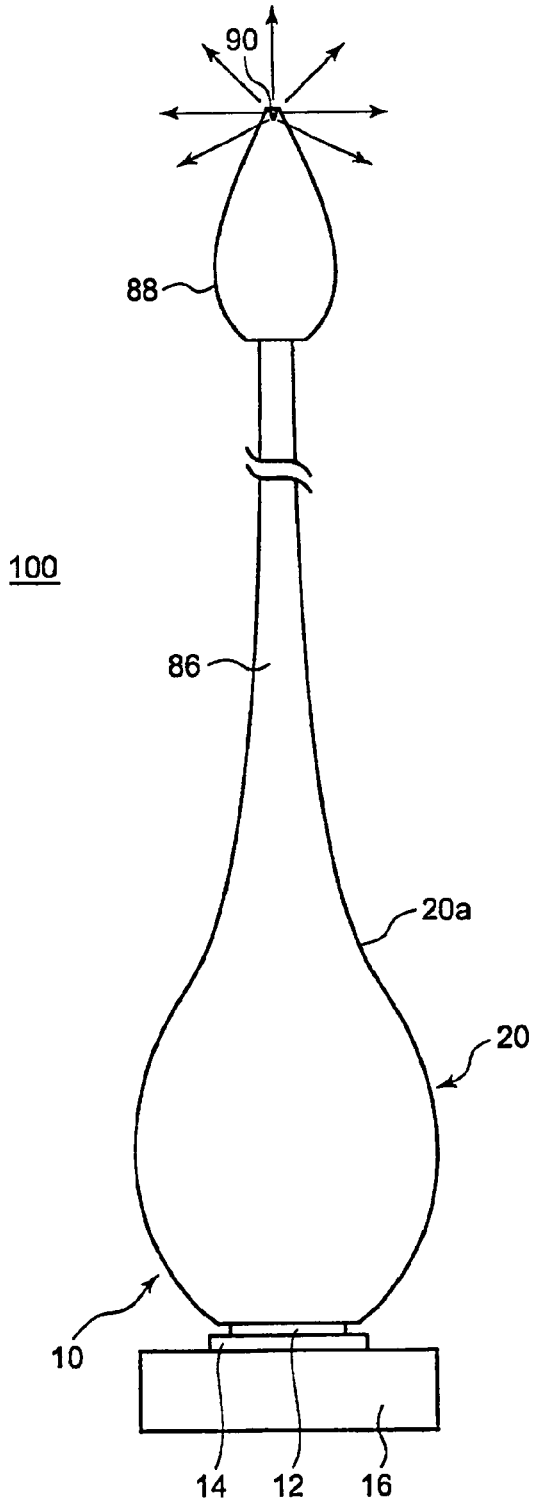
FIG. 11 is a diagram which shows a lighting system according to another embodiment of the present invention.

FIG. 11 shows a lighting system according to another embodiment of the present invention. As shown in FIG. 11, the lighting system 100 according to the present embodiment has a configuration in which an optical fiber 86 is connected to the top portion 20*a* of the teardrop-shaped translucent member 20. The teardrop-shaped translucent member 20 provides a function of focusing light on the top portion 20*a*, thereby allowing light to be input to one end of the optical fiber 86. Furthermore, a small-size teardrop-shaped translucent member 88 is provided to the other end of the optical fiber 86. The light input from the other end of the optical fiber 86 to the bottom portion of the teardrop-shaped translucent member 88 is diffused by a recessed portion 90 provided to the top portion of the teardrop-shaped translucent member 88. As descried above, the lighting system 100 can be employed as a light source for a fiber optics device.

With such a lighting system 100, the optical fiber 86 is arranged such that its end is away from the light-emitting diode 12 employed as an actual light source. Thus, there is less of an adverse effect of heat generated by the light-emitting diode 12 on such an optical fiber. Thus, such an arrangement allows a plastic optical fiber to be employed as the optical fiber 86, which provides an advantage of a low cost and an advantage of allowing the optical fiber 86 to be processed easily.

Description has been made regarding the present invention with reference to the embodiment. The above-described embodiment has been described for exemplary purposes only, and is by no means intended to be interpreted restrictively. Rather, it can be readily conceived by those skilled in this art that various modifications may be made by making various combinations of the aforementioned components, which are also encompassed in the technical scope of the present invention.

Description has been made in the above-described embodiment regarding an arrangement in which the lateral portion of the teardrop-shaped translucent member is formed so as to generate a linear image in the vicinity of the top portion. Also, the lateral portion may be configured so as to generate an image having other shapes. Also, the lateral portion may be configured to form an image obtained by reducing or otherwise expanding the shape of the light source. For example, in a case in which an image obtained by reducing the shape of a light source is to be formed, such an arrangement is capable of providing a virtual light-emitting portion at a position away from the actual light source such that it has a smaller size and a higher luminance than those of the actual light source. Also, the position at which an image is to be formed is not restricted to the top portion of, or otherwise in the vicinity of the top portion of, the teardrop-shaped translucent member. Rather, such a position at which an image is to be formed can be determined as desired. Description has been made in the aforementioned embodiments regarding an arrangement employing a teardrop-shaped translucent member. However, the shape of such a translucent member is not restricted to such a teardrop shape. Rather, such a translucent member may be configured in a desired shape so long as it has a lateral portion configured to provide total internal reflection of incident light input via the bottom portion so as to form an image at a predetermined position.

What is claimed is:

1. A light-emitting apparatus comprising:

a light source; and a translucent member configured in a teardrop shape having an approximately spheroid structure, along the longitudinal axis of which a top portion is tapered, wherein the translucent member is formed of a light-translucent material, comprising a bottom portion via which light emitted from the light source is input, a lateral portion configured to provide total internal reflection of light input via the bottom portion, and an image formation portion at which the light subjected to total internal reflection by the lateral portion is focused so as to form an image, and wherein the image formation portion is arranged in the vicinity of the top portion of the translucent member and is located on the longitudinal axis of the approximately spheroid structure.

2. A light-emitting apparatus according to claim 1, wherein the translucent member is configured to form an image obtained by alteration of the shape of the light source.

3. A light-emitting apparatus according to claim 1, wherein the translucent member is configured to form an image obtained by expanding or otherwise by reducing the shape of the light source.

4. A light-emitting apparatus according to claim 1, wherein the translucent member further includes a plurality of reflectors embedded therewithin.

5. A light-emitting apparatus according to claim 1, wherein the translucent member further includes a diffusion portion configured to diffuse, to the exterior of the translucent member, the light from an image formed at the image formation portion.

6. A light-emitting apparatus according to claim 1, wherein the light source is configured as a light-emitting diode.

7. A lighting system comprising:

a light-emitting apparatus according to claim 1; and an optical member configured to control the light emitted from the light-emitting apparatus so as to provide a predetermined light distribution.

8. A lighting system according to claim 7, wherein the optical member includes a reflector portion configured to reflect, in a predetermined direction, the light emitted from the light-emitting apparatus.

* * * * *